US010802434B2

(12) United States Patent
Nakamoto

(10) Patent No.: US 10,802,434 B2
(45) Date of Patent: Oct. 13, 2020

(54) FIXING DEVICE MAKING SEPARATING MEMBER CONTACT OR SEPARATE WITH REGARD TO HEATING MEMBER BY INTERLOCKING WITH PRESSURE APPLYING MEMBER AND IMAGE FORMING APPARATUS INCLUDING THE SAME

(71) Applicant: KYOCERA Document Solutions Inc., Osaka (JP)

(72) Inventor: Fumito Nakamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 47 days.

(21) Appl. No.: 16/398,784

(22) Filed: Apr. 30, 2019

(65) Prior Publication Data

US 2019/0346798 A1 Nov. 14, 2019

(30) Foreign Application Priority Data

May 8, 2018 (JP) ..... 2018-090026

(51) Int. Cl.
*G03G 15/20* (2006.01)

(52) U.S. Cl.
CPC ..... *G03G 15/2064* (2013.01); *G03G 15/2017* (2013.01); *G03G 2221/1657* (2013.01)

(58) Field of Classification Search
CPC ..... G03G 15/2035; G03G 15/2032; G03G 15/2064; G03G 15/2028
See application file for complete search history.

(56) References Cited

U.S. PATENT DOCUMENTS 9,128,448 B2 * 9/2015 Maruta ..... G03G 15/80
9,804,542 B2 * 10/2017 Hidaka ..... G03G 15/2028

FOREIGN PATENT DOCUMENTS

JP S63148285 A 6/1988

* cited by examiner

*Primary Examiner* — Arlene Heredia
(74) *Attorney, Agent, or Firm* — Studebaker & Brackett PC

(57) ABSTRACT

A fixing device includes a heating member heating a toner on a medium, a pressuring member, a pressure applying member, a pressure adjusting mechanism and a separating member. The pressuring member pressure-contacts with the heating member to form a pressuring area and pressurizes the medium passing through the pressuring area. The pressure applying member presses the pressuring member to generate fixing pressure in the pressuring area. The pressure adjusting mechanism switches the fixing pressure between first pressure and second pressure lower than the first pressure. The separating member contacts with the heating member to release the medium from the heating member. The separating member contacts with the heating member by interlocking with the pressure applying member when the pressure applying member applies the first pressure, and is separated from the heating member by interlocking with the pressure applying member when the pressure applying member applies the second pressure.

14 Claims, 15 Drawing Sheets

FIXING DEVICE MAKING SEPARATING MEMBER CONTACT OR SEPARATE WITH REGARD TO HEATING MEMBER BY INTERLOCKING WITH PRESSURE APPLYING MEMBER AND IMAGE FORMING APPARATUS INCLUDING THE SAME

INCORPORATION BY REFERENCE

This application is based on and claims the benefit of priority from Japanese Patent application No. 2018-090026 filed on May 8, 2018, the entire contents of which are incorporated herein by reference.

BACKGROUND

The present disclosure relates to a fixing device fixing a toner on a recording medium passing through a pressuring area and an image forming apparatus including the fixing device.

An image forming apparatus, such as a copying machine or a printer, of an electrographic manner includes a fixing device fixing a toner on a recording medium, such as a sheet. The fixing device includes a heating member heating the toner on the recording medium, and a pressuring member coming into pressure contact with the heating member to form a pressuring area and pressuring the recording medium passing through the pressuring area. As an example of a fixing manner, a heating roller manner melting and fixing the toner by a heated rotating roller is cited.

The recording medium passed through the pressuring area may be wound around a heating roller due to adhesive power of the melt toner and others. In a conventional fixing device, in order to prevent the above-mentioned winding of the recording medium, a way releasing the recording medium from the heating roller by a separation claw provided in the fixing device is applied.

In order to release the recording medium, it is necessary to bring the separation claw into contact with the heating roller. However, if the separation claw continues to come into contact with the heating roller, frictional wear of a circumference face of the heating roller may occur. The above-mentioned wear of the circumference face causes failure of image forming to the recording medium and others.

Thereupon, in the conventional fixing device, it is proposed to restrain unnecessary contact of the separation claw by providing a contact releasing mechanism releasing the separation claw from the heating roller.

In the contact releasing mechanism in the conventional fixing device, a plunger is protruded by energizing a solenoid to move the separation claw. That is, in the conventional fixing device, an individual power source is provided in order to release the separation claw from the heating member. In accordance with the above-mentioned configuration, although releasing of the separation claw from the heating member may be achieved, there are possibilities that structure of the fixing device is complicated, and moreover, an installed space and a manufacturing cost for the fixing device are increased.

SUMMARY

In accordance with the present disclosure, a fixing device includes a heating member, a pressuring member, a pressure applying member, a pressure adjusting mechanism and a separating member. The heating member heats a toner on a recording medium. The pressuring member comes into pressure contact with the heating member to form a pressuring area and pressurizes the recording medium passing through the pressuring area. The pressure applying member presses the pressuring member to generate predetermined fixing pressure in the pressuring area. The pressure adjusting mechanism is capable of switching the fixing pressure applied by the pressure applying member between at least two steps of first pressure and second pressure lower than the first pressure. The separating member comes into contact with the heating member to release the recording medium from the heating member. The separating member comes into contact with the heating member by interlocking with the pressure applying member in a case where the pressure applying member applies the first pressure, and, on the other hand, the separating member is separated from the heating member by interlocking with the pressure applying member in a case where the pressure applying member applies the second pressure.

In accordance with the present disclosure, an image forming apparatus includes the fixing device as described above.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
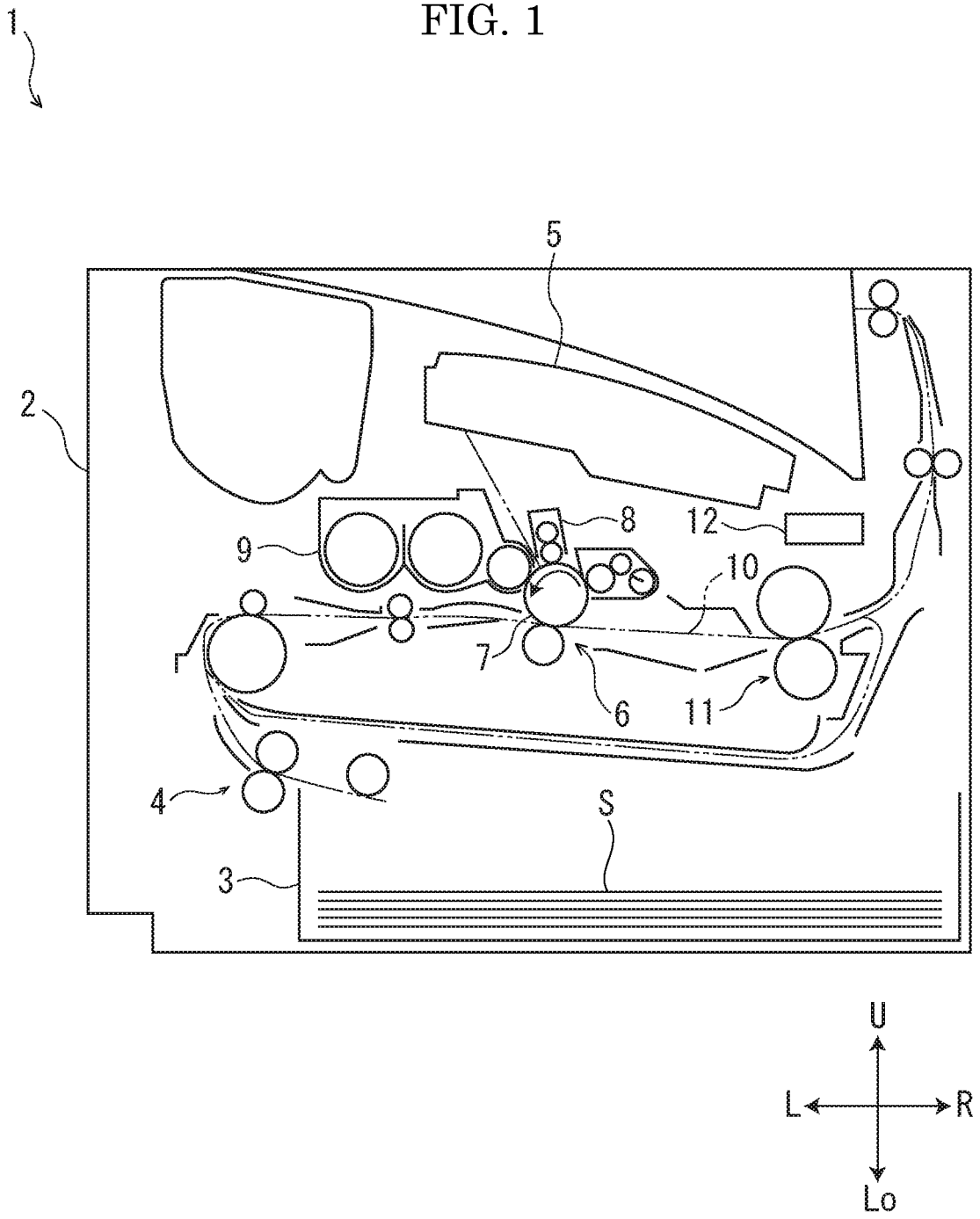
FIG. 1 is a sectional view schematically showing an image forming apparatus according to an embodiment of the present disclosure.

Hereinafter, with reference to the accompanying drawings, plural embodiments of the present disclosure will be described. Incidentally, it will be described so that the front side is positioned at a near side on a paper sheet of FIG. 1 and other figures, and in each figure, a reference character "L" indicates a left side, a reference character "R" indicates a right side, a reference character "Fr" indicates a front side and a reference character "Rr" indicates a rear side.

With reference to FIG. 1, the entire structure of an image forming apparatus 1 will be described. The image forming apparatus 1 of the present embodiment is a monochrome printer fixing a toner to a sheet S as a recording medium. FIG. 1 is a sectional view schematically showing an internal structure of the image forming apparatus 1.

The image forming apparatus 1 includes an apparatus body 2 constituting an external appearance in a roughly rectangular parallelepiped shape. In a lower part of the apparatus body 2, a sheet feeding cartridge 3 storing the sheets S made of paper is detachably attached. On an upper face of the apparatus body 2, an ejected sheet tray is provided. Incidentally, the sheet S as an example of the recording medium is not restricted by paper, but may be a sheet made of resin or others.

In an upper part of the apparatus body 2, an exposing device 5 composed of a laser scanning unit (LSU) is arranged below the ejected sheet tray. Below the exposing device 5, an image forming part 6 is arranged. In the image forming part 6, a photosensitive drum 7 as an image carrier is rotatably arranged. Around the photosensitive drum 7, a charging device 8, a developing device 9 connected to a toner container, a transferring roller and a cleaning device are arranged along a rotating direction of the photosensitive drum 7. One end (e.g. a rear end) of a rotation shaft of the photosensitive drum 7 is connected to a drive source, such as a motor, and the photosensitive drum 7 is rotated by rotation driving force transmitted from the drive source.

Inside the apparatus body 2, a conveying path 10 for the sheet S is arranged. A sheet feeding device 4 is arranged at an upstream end in the conveying path 10 extended from the sheet feeding cartridge 3 to the ejected sheet tray. A fixing device 11 is arranged at a downstream side in the conveying path 10, and the image forming part 6 is arranged between the sheet feeding device 4 and the fixing device 11 in the conveying path 10. Hereinafter, a direction conveying the sheet S on the conveying path 10 is indicated as a "conveying direction".

The apparatus body 2 further is provided with a controlling device 12 controlling each component of the image forming apparatus 1. Moreover, the apparatus body 2 is provided with a displaying part displaying states of the image forming apparatus 1 in its upper face or a side face. The displaying part is composed of, for example, a touch panel, a display or the like.

Image forming operation (image forming process) of the image forming apparatus 1 including such configuration as described above will be schematically described. In the image forming apparatus 1, when image data is inputted and a printing start is directed from an external computer or the like, the controlling device 12 controls each component to start image forming operation. The charging device 8 of the image forming part 6 electrically charges a surface of the photosensitive drum 7. The exposing device 5 irradiates the surface of the photosensitive drum 7 with a laser light corresponding to the image data to form an electrostatic latent image on the surface of the photosensitive drum 7. The developing device 9 of the image forming part 6 develops the electrostatic latent image to a toner image by using a toner. The photosensitive drum 7 carries the developed toner image.

On the other hand, the sheet S is fed out from the sheet feeding cartridge 3 to the conveying path 10 by the sheet feeding device 4. The sheet S on the conveying path 10 is conveyed to the image forming part 6 in a given timing, and the toner image on the surface of the photosensitive drum 7 is transferred on the sheet S. The sheet S with the transferred toner image is conveyed to the fixing device 11, and the toner image is fixed on the sheet S by the fixing device 11. The sheet S with the fixed toner image is ejected to the ejected sheet tray.

Figure 2:
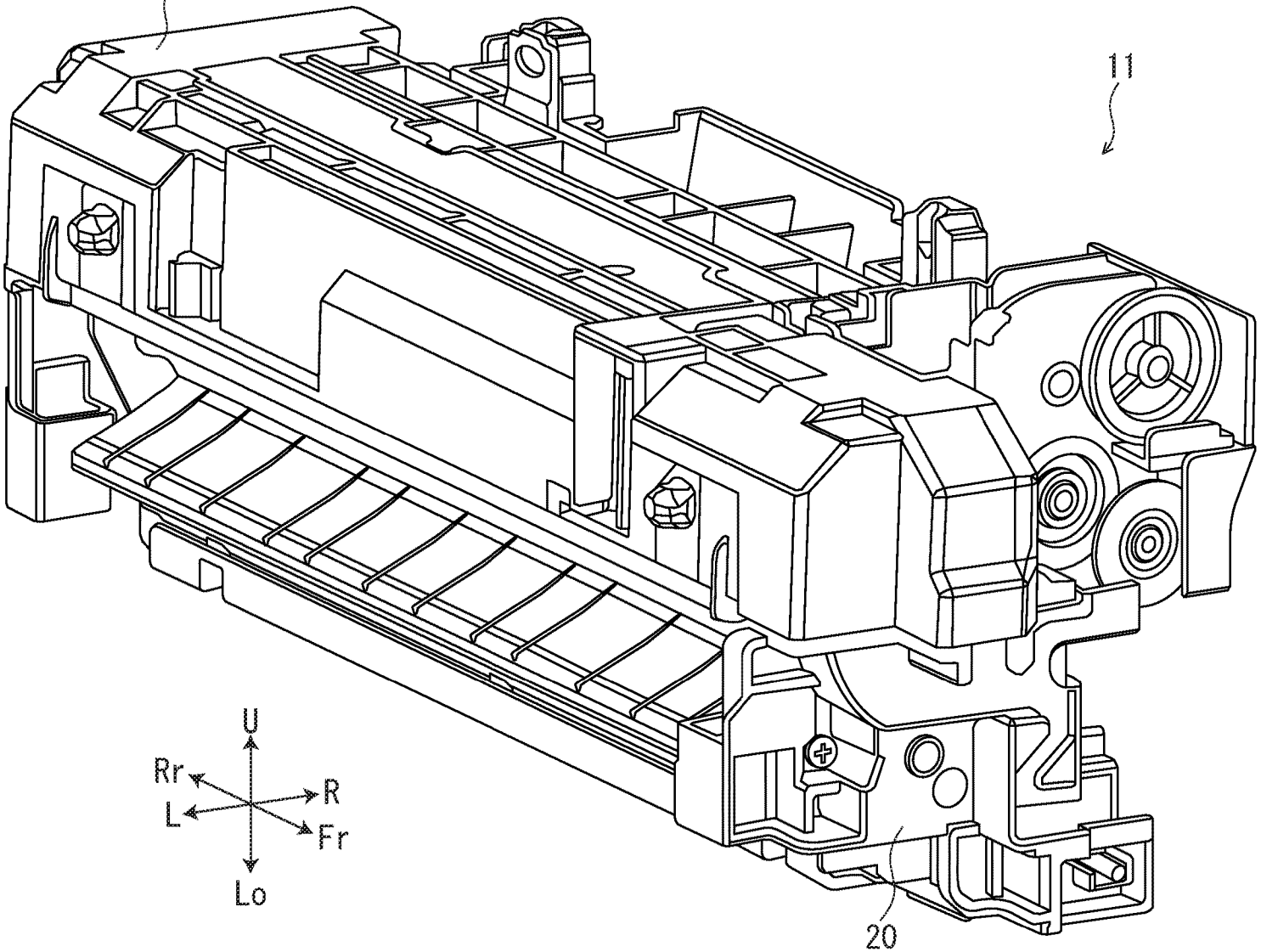
FIG. 2 is a perspective view showing a fixing device, as viewed from an upstream side, according to the embodiment of the present disclosure.
Figure 3:
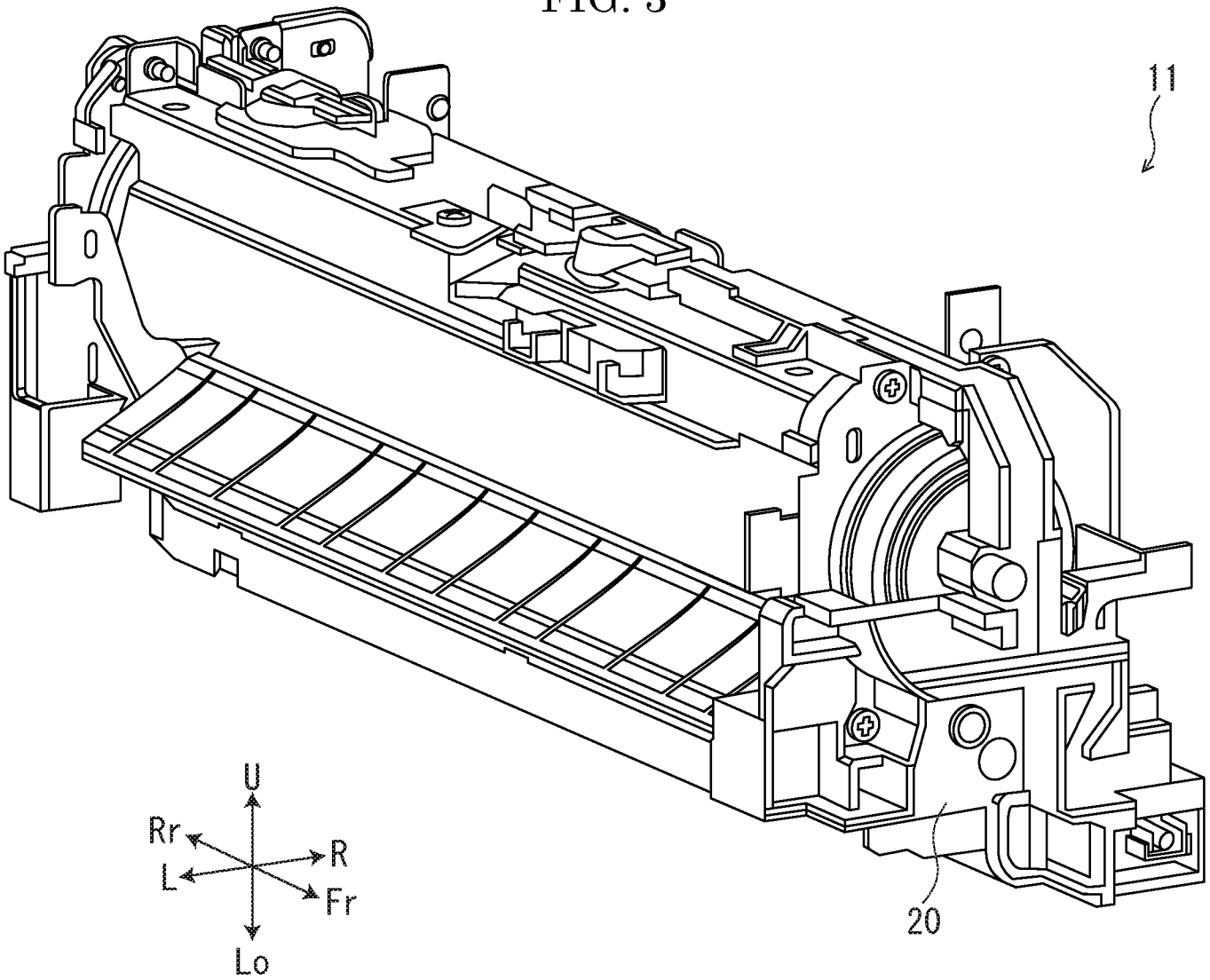
FIG. 3 is a perspective view showing the fixing device in a state detaching an upper cover, as viewed from the upstream side, according to the embodiment of the present disclosure.
Figure 4:
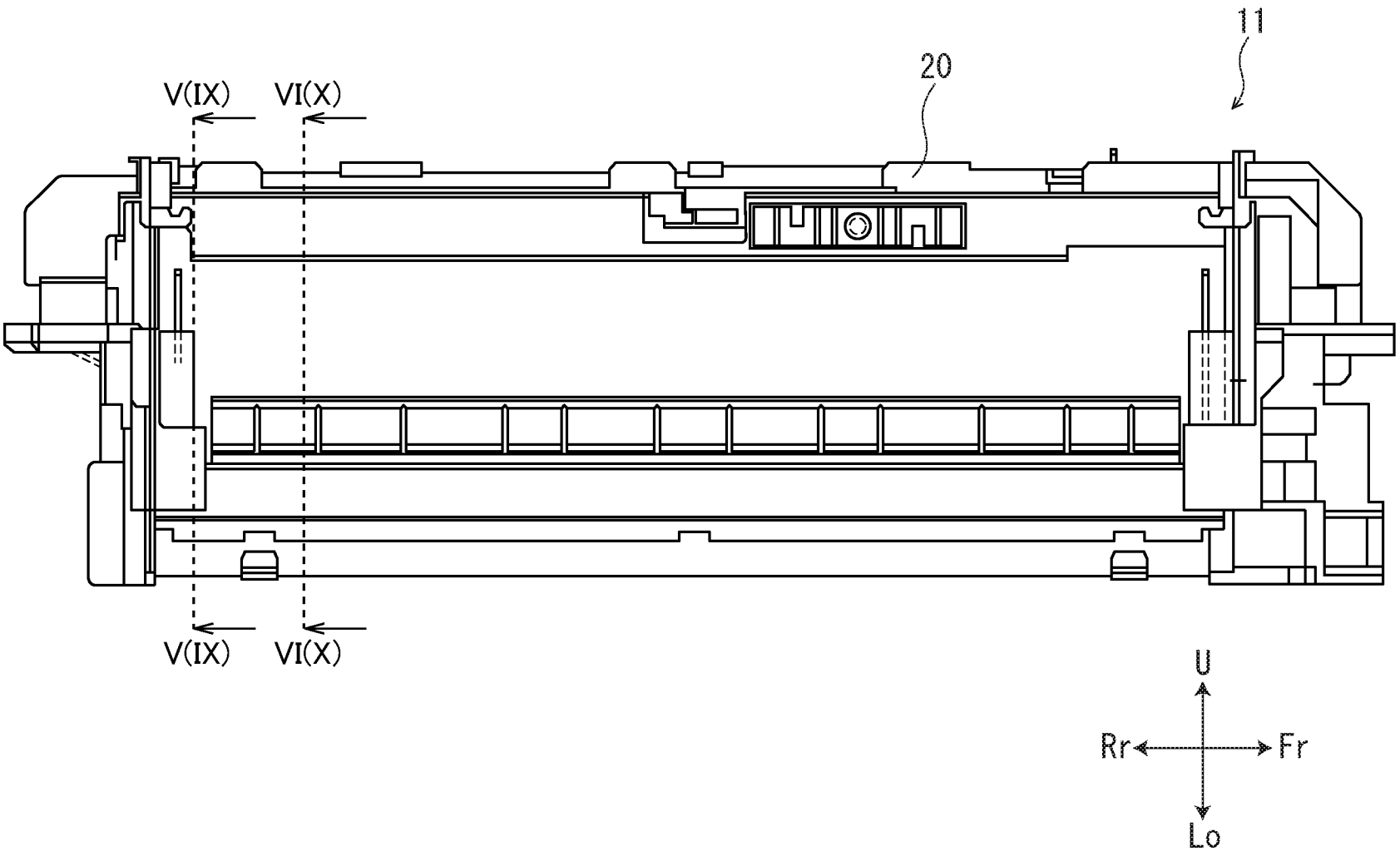
FIG. 4 is a side view showing the fixing device according to the embodiment of the present disclosure.
Figure 5:
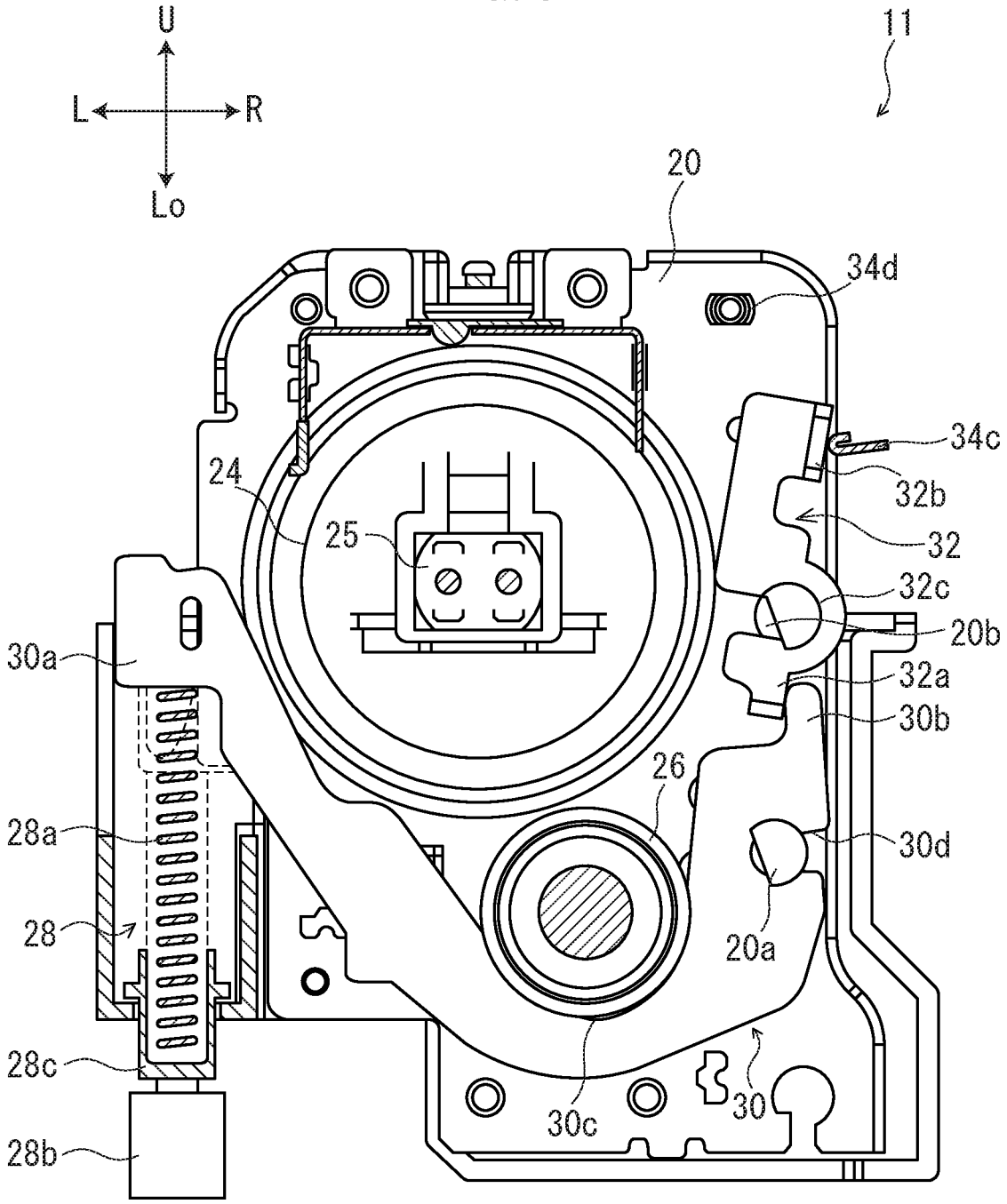
FIG. 5 is a sectional view showing the fixing device in a state releasing normal pressure along a V-V line in FIG. 4.
Figure 6:
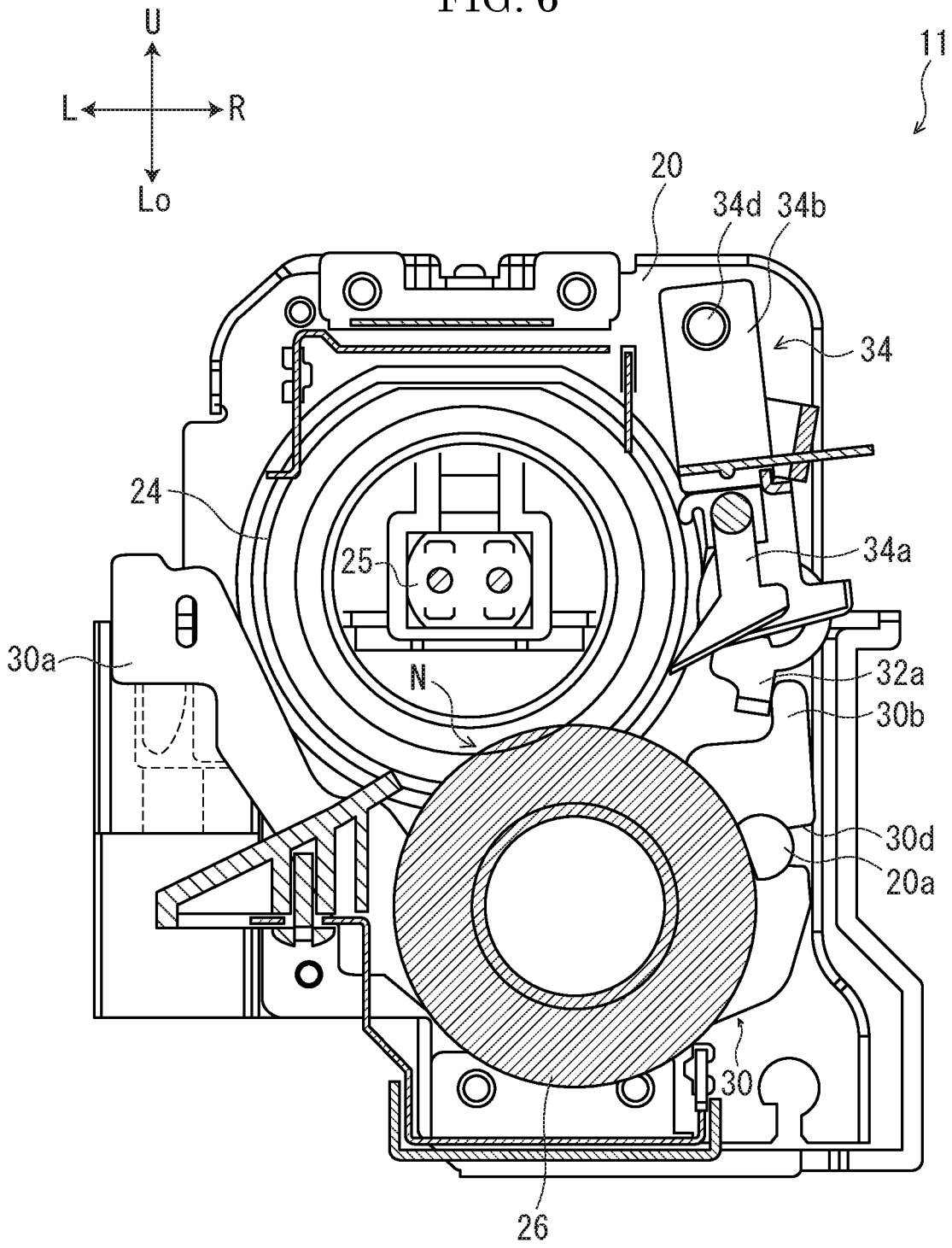
FIG. 6 is a sectional view showing the fixing device in the state releasing normal pressure along a VI-VI line in FIG. 4.
Figure 7:
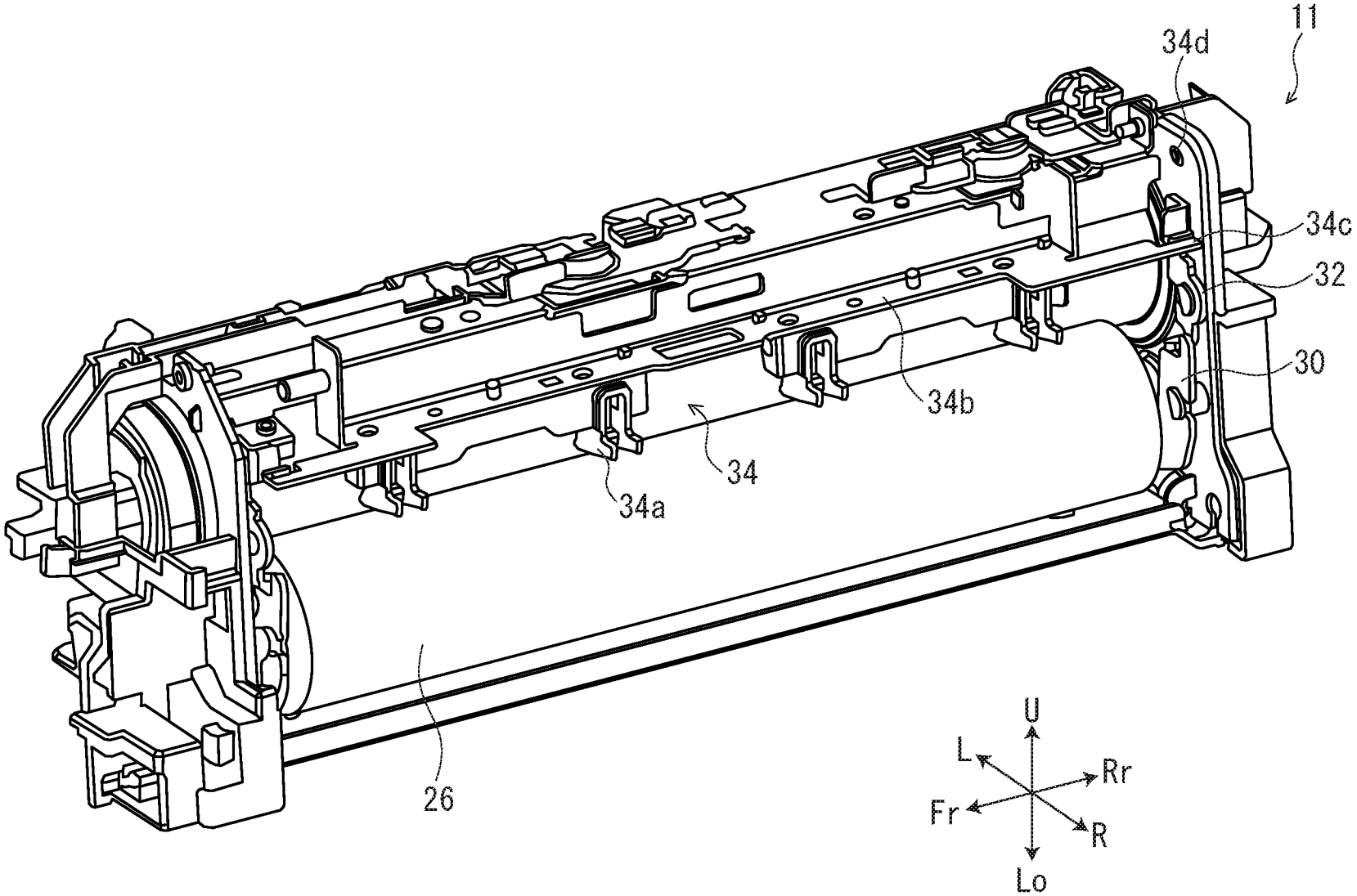
FIG. 7 is a perspective view showing the fixing device, as viewed from a downstream side, according to the embodiment of the present disclosure.

With reference to FIGS. 2-7, the fixing device 11 will be described. FIGS. 2 and 3 are sectional views showing the fixing device 11 as viewed from an upstream side in the conveying direction. FIG. 4 is a side view showing the fixing device 11 as viewed from the upstream side in the conveying direction. FIG. 5 is a sectional view along a V-V line in FIG. 4 and FIG. 6 is a sectional view along a VI-VI line in FIG. 4. FIG. 7 is a perspective view showing the fixing device 11 as viewed from a downstream side in the conveying direction. The fixing device 11 includes a casing 20, an upper cover 22, a heating roller 24 (a heating member), a pressuring roller 26 (a pressuring member), pressure adjusting mechanisms 28, pressure applying members 30, interlocking members 32 and a separating member 34.

The casing 20 is a housing formed in a roughly box shape elongated in forward and backward directions (FIG. 2 and other figures) to house and support the heating roller 24 and the pressuring roller 26 rotatably in its inside (FIGS. 5 and 6). The upper cover 22 is detachably attached to an upper part of the casing 20. FIG. 2 shows a state that the upper cover 22 is attached, and FIG. 3 shows a state that the upper cover 22 is detached.

The heating roller 24 is a member formed in a roughly cylindrical shape elongated in the forward and backward directions (an axial direction). The heating roller 24 includes a core material formed in a cylindrical tube shape, an elastic layer laminated on an outer circumference face of the core material, and a release layer covering the elastic layer (FIGS. 5 and 6). The core material is made of, for example, metal, such as aluminum. The elastic layer is made of, for example, silicone rubber or the like having elasticity. The release layer is made of, for example, fluororesin, such as PFA. In an inner space of the heating roller 24, a heater 25 composed of a halogen heater, a ceramic heater or the like. The heater 25 generates heat by electric power supplied from a not-shown power supply to heat the heating roller 24 from the inside.

The pressuring roller 26 is a member formed in a roughly columnar shape elongated in the forward and backward directions (the axial direction). The pressuring roller 26 includes a core metal formed in a columnar shape, an elastic layer laminated on an outer circumference face of the core metal, and a release layer covering the elastic layer (FIGS. 5 and 6). The core metal is made of, for example, metal, such as SUS or aluminum. The elastic layer is made of, for example, silicone rubber or the like having elasticity. The release layer is made of, for example, fluororesin, such as PFA.

The heating roller 24 is the heating member heating the toner on the sheet S while rotating around a rotation axis extended in the forward and backward directions. The pressuring roller 26 is the pressuring member coming into pressure contact with the heating roller 24 to form a fixing nip N (a pressuring area) and pressuring the sheet S passing through fixing nip N while rotating around a rotation axis extended in the forward and backward directions. The pressuring roller 26 is driven and rotated by a drive source, such as a not-shown motor. The heating roller 24 is rotated by following rotation of the pressuring roller 26.

Fixing pressure in the fixing nip N is generated when the pressure applying member 30 presses the pressuring roller 26 and the pressuring roller 26 comes into pressure contact with the heating roller 24. As described below in detail, the pressure adjusting mechanism 28 adjusts fixing pressure of the fixing nip N on the basis of a sheet type of the sheet S and the state of the fixing device 11.

For example, in a case where the sheet S passing through the fixing nip N is a plain paper, the controlling device 12 controls the pressure adjusting mechanism 28 so that the pressure applying member 30 applies normal pressure (first pressure) as normal fixing pressure to the fixing nip N. In a case where the sheet S passing through the fixing nip N is a high basis weight paper, such as an envelope and a postcard, the controlling device 12 controls the pressure adjusting mechanism 28 so as to release the normal pressure and so that the pressure applying member 30 applies release pressure (second pressure) lower than the normal pressure to the fixing nip N.

In other word, the pressure adjusting mechanism 28 can switch the fixing pressure applied by the pressure applying member 30 between two steps of the normal pressure and the release pressure. FIGS. 4 and 5 shows a state that the pressure adjusting mechanism 28 makes the pressure applying member 30 applied the release pressure (the second pressure) to the fixing nip N (a state that the normal pressure is released).

The pressure adjusting mechanism 28 may be controlled so as to apply other fixing pressure (e.g. third pressure higher than the normal pressure) in addition to the normal pressure and the release pressure. That is, the pressure adjusting mechanism 28 can adopt an optional configuration capable of switching between at least two steps of fixing pressure.

The pressure adjusting mechanisms 28, the pressure applying members 30 and the interlocking members 32 are provided at front and rear ends of the casing 20, respectively. That is, the fixing device 11 includes a pair of pressure adjusting mechanisms 28, a pair of pressure applying members 30 and a pair of interlocking members 32. Hereinafter, although the pressure adjusting mechanism 28, the pressure applying member 30 and the interlocking member 32 arranged at a rear side of the casing 20 will be described as an example, the same description can be naturally adopted to each component arranged at a front side of the casing 20. Incidentally, a configuration that the fixing device 11 includes one pressure adjusting mechanism 28, one pressure applying member 30 and one interlocking member 32 at any one of the front and rear ends may be adopted.

The pressure applying member 30 is made of metal plate and is formed in a roughly U-shape as viewed from a front side. In one end (a left end) of the pressure applying member 30, an elastic body receiving part 30*a* is provided, and in the other end (a right end) of the pressure applying member 30, a first engaging part 30*b* is provided. The elastic body receiving part 30*a* is engaged with an elastic body (a compression spring 28*a*) included in the pressure adjusting mechanism 28. The first engaging part 30*b* is engaged with a second engaging part 32*a* included in the interlocking member 32.

Between the elastic body receiving part 30*a* and the first engaging part 30*b*, in an intermediate part in left and right directions of the pressure applying member 30, a holding part 30*c* formed in a recessed shape opened at an upper side is provided. The holding part 30*c* is engaged with an end of the pressuring roller 26 to hold the pressuring roller 26 rotatably.

Between the holding part 30*c* and the first engaging part 30*b*, a first supporting part 30*d* formed in a recessed shape opened at a right side is provided. The first supporting part 30*d* is turnably engaged with a first rotation engaging part 20*a* provided in the casing 20. The first rotation engaging part 20*a* is a columnar body having a semicircular cross section. The first supporting part 30*d* supports the pressure applying member 30 turnably with respect to the casing 20.

The pressure adjusting mechanism 28 includes the compression spring 28*a* as the elastic body engaging with the pressure applying member 30, a solenoid 28*b* as a biasing part capable of biasing the compression spring 28*a* toward the pressure applying member 30, and a biased part 28*c* put between the compression spring 28*a* and the solenoid 28*b*.

The compression spring 28*a* is composed of, for example, a coil spring. Into an upper end of the compression spring 28*a*, a fitting protrusion provided on a lower face of the elastic body receiving part 30*a* is fitted. The biased part 28*c* is formed in a cylindrical shape having a closed lower end. A lower end of the compression spring 28*a* is fitted into the biased part 28*c*. A main frame of the solenoid 28*b* is fixedly attached to the casing 20, a plunger of the solenoid 28*b* movably provided in the main frame is protruded to press the biased part 28*c* to an upper side, and thereby, the compression spring 28*a* is biased toward the pressure applying member 30.

The interlocking member 32 is made of metal plate and is put between the pressure applying member 30 and the separating member 34. The interlocking member 32 is formed in a protruded shape and includes the second engaging part 32*a* engaging with the first engaging part 30*b* and a third engaging part 32*b* formed in a planar shape to engage with the separating member 34.

Between the second engaging part 32*a* and the third engaging part 32*b*, a second supporting part 32*c* in a recessed shape opened at a left side is provided. The second supporting part 32*c* is turnably engaged with a second rotation engaging part 20*b* provided in the casing 20. The second rotation engaging part 20*b* is a columnar body having a semicircular cross section. The second supporting part 32*c* supports the interlocking member 32 turnably with respect to the casing 20.

The separating member 34 includes a plurality of separating claws 34*a* coming into contact with the heating roller 24 separating the sheet S and a holder part 34*b* to which the separating claws 34*a* are fixedly attached (FIGS. 5-7). Each of separating claws 34*a* is fixedly attached to the holder part 34*b* by using a fastening means, such as a screw.

Moreover, the holder part 34*b* includes a fourth engaging part 34*c* engaging with the third engaging part 32*b* and a third supporting part 34*d* supporting the separating member 34 turnably. To the third supporting part 34*d*, a torsion coil spring is installed. The torsion coil spring biases the separating member 34 in a direction making the separating claws 34*a* come into contact with the heating roller 24 (a clockwise direction in FIGS. 5 and 6).

Incidentally, in FIGS. 5 and 6, although the torsion coil spring biases the separating member 34, because turning of the holder part 34*b* is restricted by interlocking member 32 (the third engaging part 32*b*), the separating claws 34*a* do not come into contact with the heating roller 24.

Figure 8:
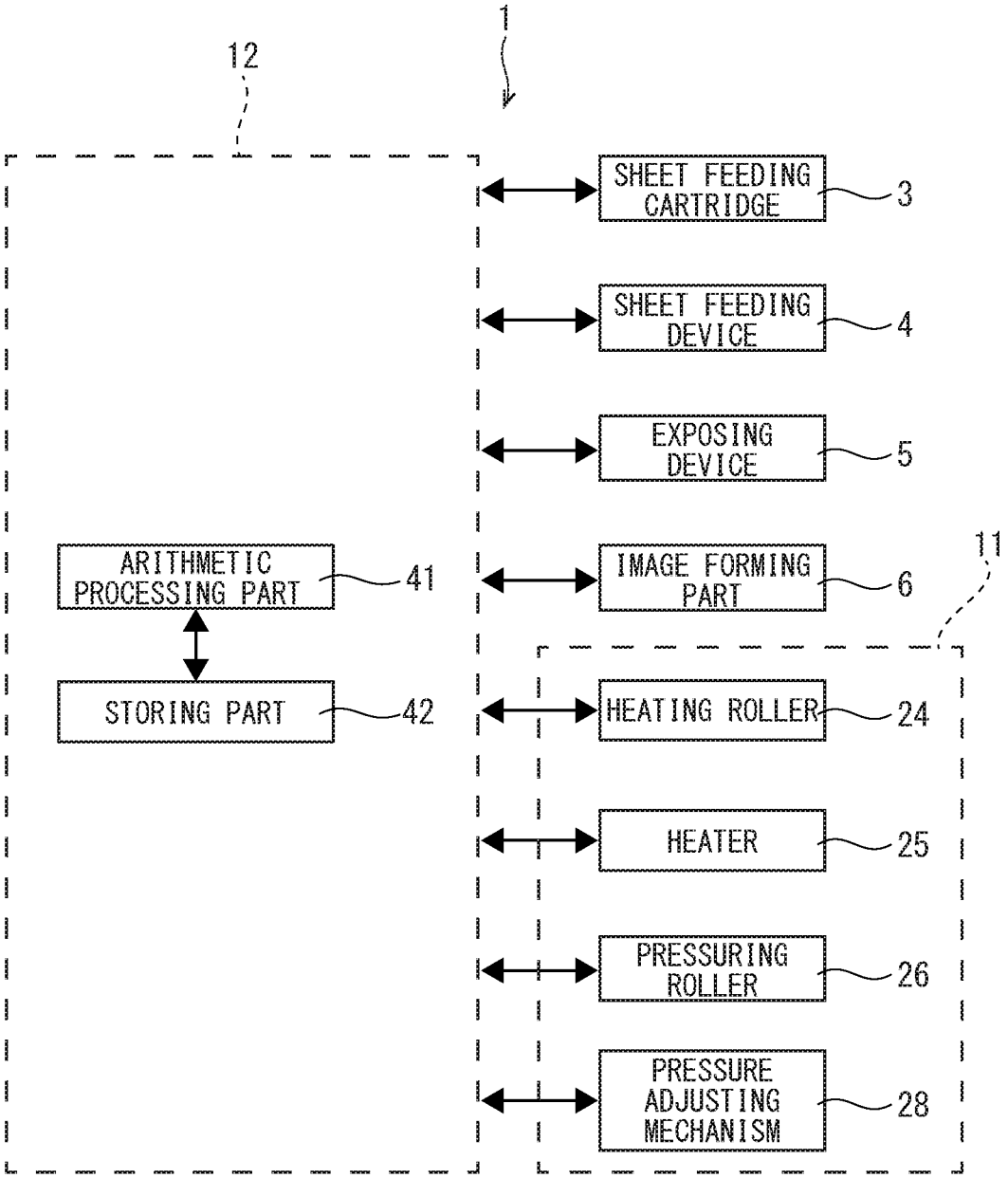
FIG. 8 is a block diagram showing a controlling device of the fixing device according to the embodiment of the present disclosure.

With reference to FIG. 8, the controlling device 12 will be described. The controlling device 12 is a device composed of a computer to include an arithmetic processing part 41 and a storing part 42. The arithmetic processing part 41 includes a microprocessor as a CPU (Central Processing Unit), and the storing part 42 includes a ROM (Read Only Memory) and a RAM (Random Access Memory).

The ROM is a readable storage medium to store programs used for boot process and controlling of the image forming apparatus 1. The RAM is a readable/writable storage medium to work as a main storage device and to store written information. Incidentally, the storing part 42 further includes an auxiliary storage device, such as a flash memory.

The arithmetic processing part 41 executes predetermined process in accordance with the program stored in the ROM and with reference to the information stored in the RAM. The arithmetic processing part 41 logically constructs various functional blocks actualized by process according to the program. Moreover, the arithmetic processing part 41 writes various information obtained by process or the like in the storing part 42.

The controlling device 12 is connected to each component, such as the sheet feeding cartridge 3, the sheet feeding device 4, the exposing device 5, the image forming part 6 and the fixing device 11, of the image forming apparatus 1. Particularly, the controlling device 12 electrically controls the pressure adjusting mechanism 28 of the fixing device 11.

In fixing operation during the image forming process, the sheet S passes through the fixing nip N as a face having the transferred toner image is faced to a side of the heating roller 24. Thereby, the toner is melt and pressurized, and then, fixed on the sheet S. The sheet S passed through the fixing nip N may be stuck to the heating roller 24 by an effect of adhesive power or the like of the melt toner. The stuck sheet S is released by the separating member 34 (the separating claws 34*a*) coming into contact with the heating roller 24.

As described above, if the separating claws 34*a* continue to come into contact with the heating roller 24 being rotated, although the sheet S is released from the heating roller 24, frictional wear of a circumference face of the heating roller 24 may occur. Thereupon, the separating member 34 of the present embodiment comes into contact with the heating roller 24 by interlocking with the pressure applying member 30 in a case where the pressure applying member 30 applies the normal pressure (the first pressure) to the fixing nip N, and, on the other hand, the separating member 34 is separated from the heating roller 24 by interlocking with the pressure applying member 30 in a case where the pressure applying member 30 applies the release pressure (the second pressure) to the fixing nip N. Interlocking operation of the separating member 34 and the pressure applying member 30 as described above will be described in more detail.

First, details of operation of each component when the fixing pressure in the fixing nip N is changed from the release pressure to the normal pressure will be described as follows. Schematically, the separating claws 34*a* comes into contact with the heating roller 24 by interlocking with applying of the normal pressure by the pressure applying member 30.

Figure 9:
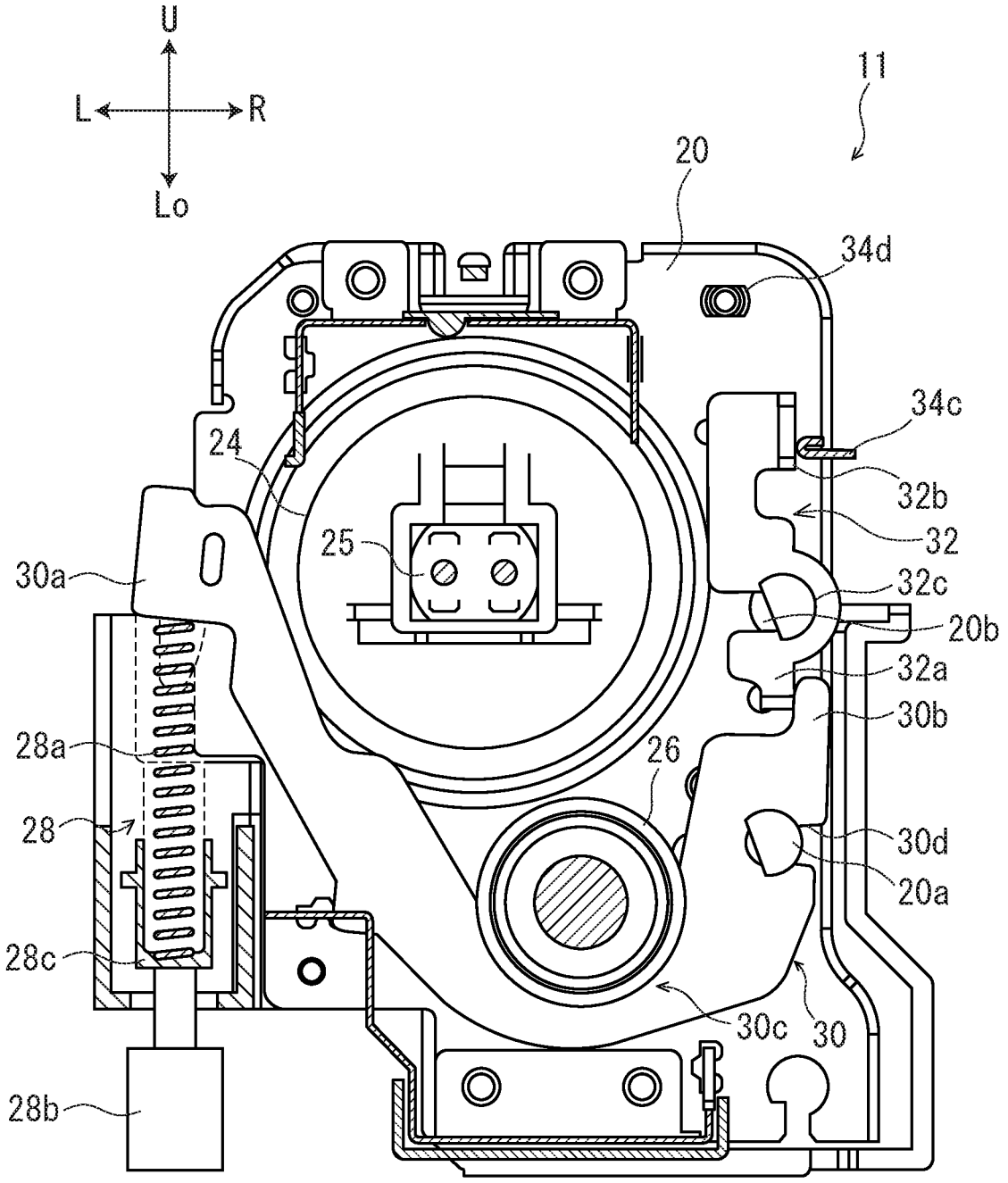
FIG. 9 is a sectional view showing the fixing device in a state applying normal pressure along a IX-IX line in FIG. 4.
Figure 10:
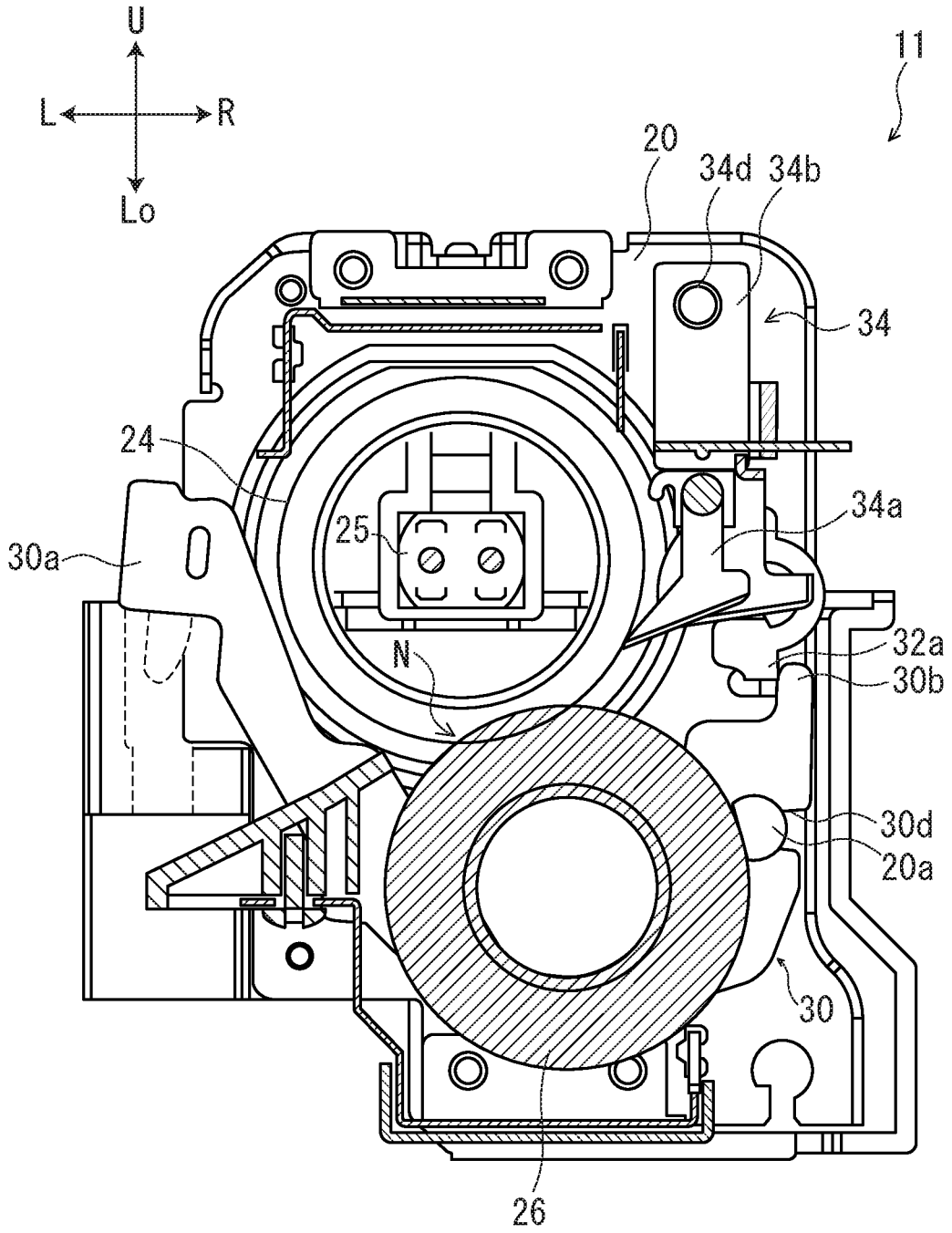
FIG. 10 is a sectional view showing the fixing device in the state applying normal pressure along a X-X line in FIG. 4.

FIG. 9 is a sectional view along a IX-IX line in FIG. 4, and its cut position is similar to FIG. 5. FIG. 10 is a sectional view along a X-X line in FIG. 4, and its cut position is similar to FIG. 6. FIGS. 9 and 10 show a state that the pressure adjusting mechanism 28 makes the pressure applying member 30 applied the normal pressure (the first pressure) to the fixing nip N.

When the solenoid 28*b* (the biasing part) of the pressure adjusting mechanism 28 biases the compression spring 28*a* (the elastic body), the pressure applying member 30 is turned around the first supporting part 30*d* in a clockwise direction (a first direction) in FIGS. 9 and 10. By above-described turning of the pressure applying member 30, the holding part 30*c* presses the pressuring roller 26 to apply the normal pressure (the first pressure) to the fixing nip N, and pressing of the first engaging part 30*b* to the second engaging part 32*a* is released.

When pressing to the second engaging part 32*a* is released, the interlocking part 32 is turned around the second supporting part 32*c* in a counter clockwise direction (a second direction) in FIGS. 9 and 10. By above-described turning of the interlocking member 32, pressing of the third engaging part 32*b* to the fourth engaging part 34*c* is released.

When pressing to the fourth engaging part 34*c* is released, the separating member 34 is turned around the third supporting part 34*d* in a clockwise direction (a third direction) in FIGS. 9 and 10 by biasing of the third supporting part 34*d* (in detail, the torsion coil spring installed to the third supporting part 34*d*). By above-described turning of the separating member 34, the separating claws 34*a* come into contact with the heating roller 24.

Next, details of operation of each component when the fixing pressure in the fixing nip N is changed (released) from the normal pressure to the release pressure will be described as follows. Schematically, the separating claws 34*a* are separated from the heating roller 24 by interlocking with releasing of the normal pressure (applying of the release pressure) by the pressure applying member 30. An opportunity changing from the normal pressure to the release pressure is, for example, occurring of paper jam in the fixing device 11.

Figure 11:
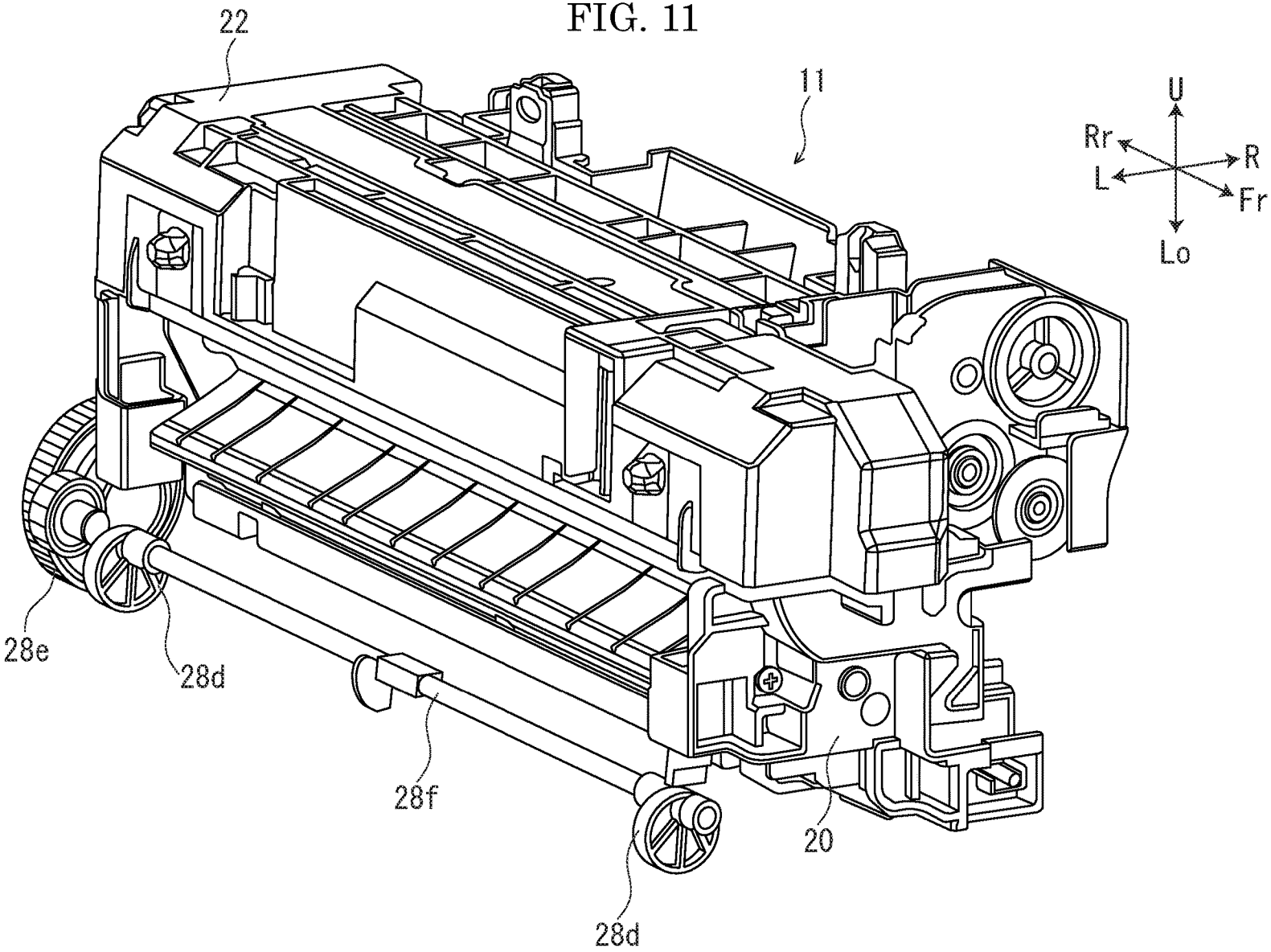
FIG. 11 is a perspective view showing the fixing device, as viewed from the upstream side, according to a modified example of the present disclosure.

When the solenoid 28*b* of the pressure adjusting mechanism 28 releases biasing to the compression spring 28*a*, the pressure applying member 30 is turned around the first supporting part 30*d* in a counter clockwise direction (an opposite direction to the first direction) in FIGS. 10 and 11. By above-described turning of the pressure applying member 30, pressing of the holding part 30*c* to the pressuring roller 26 is released to apply the release pressure (the second pressure) to the fixing nip N, and the first engaging part 30*b* presses the second engaging part 32*a*.

When the second engaging part 32*a* is pressed, the interlocking member 32 is turned around the second supporting part 32*c* in a clockwise direction (an opposite direction to the second direction) in FIGS. 10 and 11. By above-described turning of the interlocking member 32, the third engaging part 32*b* presses the fourth engaging part 34*c*.

When the fourth engaging part 34*c* is pressed, the separating member 34 is turned around the third supporting part 34*d* in a counter clockwise direction (an opposite direction to the third direction) in FIGS. 10 and 11. By above-described turning of the separating member 34, the separating claws 34*a* are separated from the heating roller 24.

As described above, the fixing device 11 of the present embodiment includes the heating roller 24 heating the toner on the sheet S, the pressuring roller 26 coming into pressure contact with the heating roller 24 to form the fixing nip N and pressurizing the sheet S passing through the fixing nip N, the pressure applying member 30 pressing the pressuring roller 26 to generate the predetermined fixing pressure in the fixing nip N, the pressure adjusting mechanism 28 capable of switching the fixing pressure applied by the pressure applying member 30 between at least two steps of the normal pressure (the first pressure) and the release pressure (the second pressure) lower than the normal pressure, and the separating member 34 coming into contact with the heating roller 24 to release the sheet S from the heating roller 24. The separating member 34 comes into contact with the heating roller 24 by interlocking with the pressure applying member 30 in the case where the pressure applying member 30 applies the normal pressure, and, on the other hand, the separating member 34 is separated from the heating roller 24 by interlocking with the pressure applying member 30 in the case where the pressure applying member 30 applies the release pressure.

In accordance with the above-described configuration, since the separating member 34 comes into contact with and is separated from the heating roller 24 by interlocking with the pressure applying member 30 applying the fixing pressure to the fixing nip N, it is possible to appropriately release the recording medium from the heating roller 24. Since new power source for moving the separating member 34 is not required, it is possible to simplify the configuration of the fixing device 11.

Moreover, in the present embodiment, the fixing device 11 further includes the interlocking member 32 put between the pressure applying member 30 and the separating member 34. The pressure adjusting mechanism 28 includes the elastic body (e.g. the compression spring 28*a*) engaged with the pressure applying member 30, and the biasing part (e.g. the solenoid 28*b*) capable of biasing the elastic body to the pressure applying member 30. The pressure applying member 30 includes the elastic body receiving part 30*a* arranged in one end of the pressure applying member 30 to engage with the elastic body, the first engaging part 30*b* arranged in the other end of the pressure applying member 30 to engage with the interlocking member 32, the holding part 30*c* arranged between the elastic body receiving part 30*a* and the first engaging part 30*b* to hold the pressuring roller 26, and the first supporting part 30*d* arranged between the holding part 30*c* and the first engaging part 30*b* to support the pressure applying member 30 turnably. The interlocking member 32 includes the second engaging part 32*a* engaging with the first engaging part 30*b* of the pressure applying member 30, the third engaging part 32*b* engaging with the separating member 34, and the second supporting part 32*c* arranged between the second engaging part 32*a* and the third engaging part 32*b* to support the interlocking member turnably. The separating member 34 includes the separating claws 34*a* coming into contact with the heating roller 24, and the holder part 34*b* to which the separating claws 34*a* are fixedly attached. The holder part 34*b* includes the fourth engaging part 34*c* engaging with the third engaging part 32*b* of the interlocking member 32, and the third supporting part 34*d* supporting the separating member 34 turnably and biasing the separating member 34 in the direction making the separating claws 34*a* come into contact with the heating roller 24.

In accordance with the above-described configuration, since, by providing the interlocking member 32 in the fixing device 11, biasing force of the pressure adjusting mechanism 28 to the pressure applying member 30 is transmitted to the separating member 34 via the interlocking member 32, it is possible to design a direction pressing the pressuring roller 26 by the holding part 30*c* of the pressure applying member 30 and a direction moving the separating claws 34*a* by the separating member 34 in high degree of freedom.

Moreover, in the fixing device 11 of the present embodiment, when the biasing part of the pressure adjusting mechanism 28 biases the elastic body, the pressure applying member 30 is turned around the first supporting part 30*d* in the first direction, the holding part 30*c* presses the pressuring roller 26 to apply the normal pressure (the first pressure) to the fixing nip N, and pressing of the first engaging part 30*b* to the second engaging part 32*a* is released. The interlocking member 32 is turned around the second supporting part 32*c* in the second direction by releasing pressing to the second engaging part 32*a*, and pressing of the third engaging part 32*b* to the fourth engaging part 34*c* is released. The separating member 34 is turned around the third supporting part 34*d* in the third direction by releasing pressing to the fourth engaging part 34*c* and biasing of the third supporting part 34*d* (in detail, the torsion coil spring installed to the third supporting part 34*d*), and the separating claws 34*a* come into contact with the heating roller 24. On the other hand, when the biasing part of the pressure adjusting mechanism 28 releases biasing to the elastic body, the pressure applying member 30 is turned around the first supporting part 30*d* in the opposite direction to the first direction, pressing of the holding part 30*c* to the pressuring roller 26 is released to apply the release pressure (the second pressure) to the fixing nip N, and the first engaging part 30*b* presses the second engaging part 32*a*. The interlocking member 32 is turned around the second supporting part 32*c* in the opposite direction to the second direction by pressing to the second engaging part 32*a*, and the third engaging part 32*b* presses the fourth engaging part 34*c*. The separating member 34 is turned around the third supporting part 34*d* in the opposite direction to the third direction by pressing to the fourth engaging part 34*c*, and the separating claws 34*a* are separated from the heating roller 24.

In accordance with the above-described configuration, as a result of interlocking each component as the biasing part biases the elastic body, applying the normal pressure to the pressuring roller 26 and contact of the separating claws 34*a* to the heating roller 24 are interlocked, and, on the other hand, as a result of interlocking each component as biasing of the biasing part to the elastic body is released, applying the release pressure to the pressuring roller 26 and separation of the separating claws 34*a* from the heating roller 24 are interlocked. Therefore, it is possible to achieve adjustment of the fixing pressure and movement of the separating claws 34*a* by a simple configuration.

Further, the pressure adjusting mechanism 28 of the present embodiment adjusts the pressure applying member 30 so as to release the normal pressure (the first pressure) and to apply the release pressure (the second pressure) to the fixing nip N in a case where the high basis weight paper as the recording medium is passed through the fixing nip N.

In accordance with the above-described configuration, when executing the fixing process to the high basis weight paper, the appropriate release pressure is applied to the high basis weight paper. Therefore, it is possible to achieve high quality image forming in the high basis weight paper.

Furthermore, in the configuration of the present embodiment, the image forming apparatus 1 including the above-described fixing device 11 can be actualized.

The above-described embodiment is variously modified. Hereinafter, a modified example of the embodiment will be described. two or more aspects optionally chosen from the embodiment and the modified example may be suitably combined without any contradiction to each other.

Although, in the above-described embodiment, the solenoid 28*b* is adopted as the biasing part of the pressure adjusting mechanism 28, the present disclosure may adopt the other optional configuration as the biasing part. For example, in the modified example of the disclosure, the pressure adjusting mechanism 28 may include the compression spring 28*a* as the elastic body, an eccentric cam 28*d* as the biasing part, the biased part 28*c* put between the compression spring 28*a* and the eccentric cam 28*d*, a drive gear train 28*e* transmitting drive force to the eccentric cam 28*d* to rotate the eccentric cam 28*d*.

Figure 12:
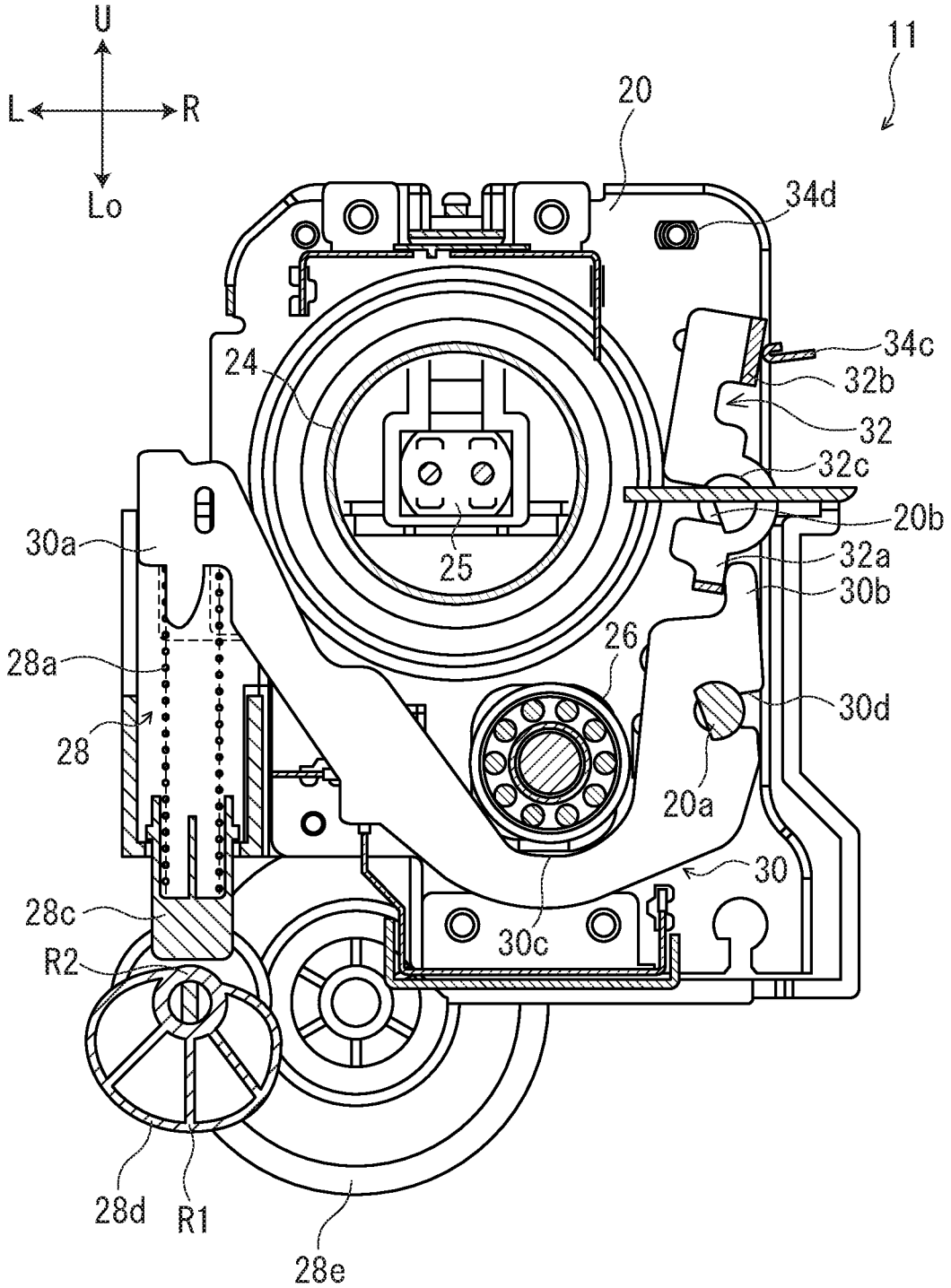
FIG. 12 is a sectional view showing the fixing device according to the modified example of the present disclosure.
Figure 13:
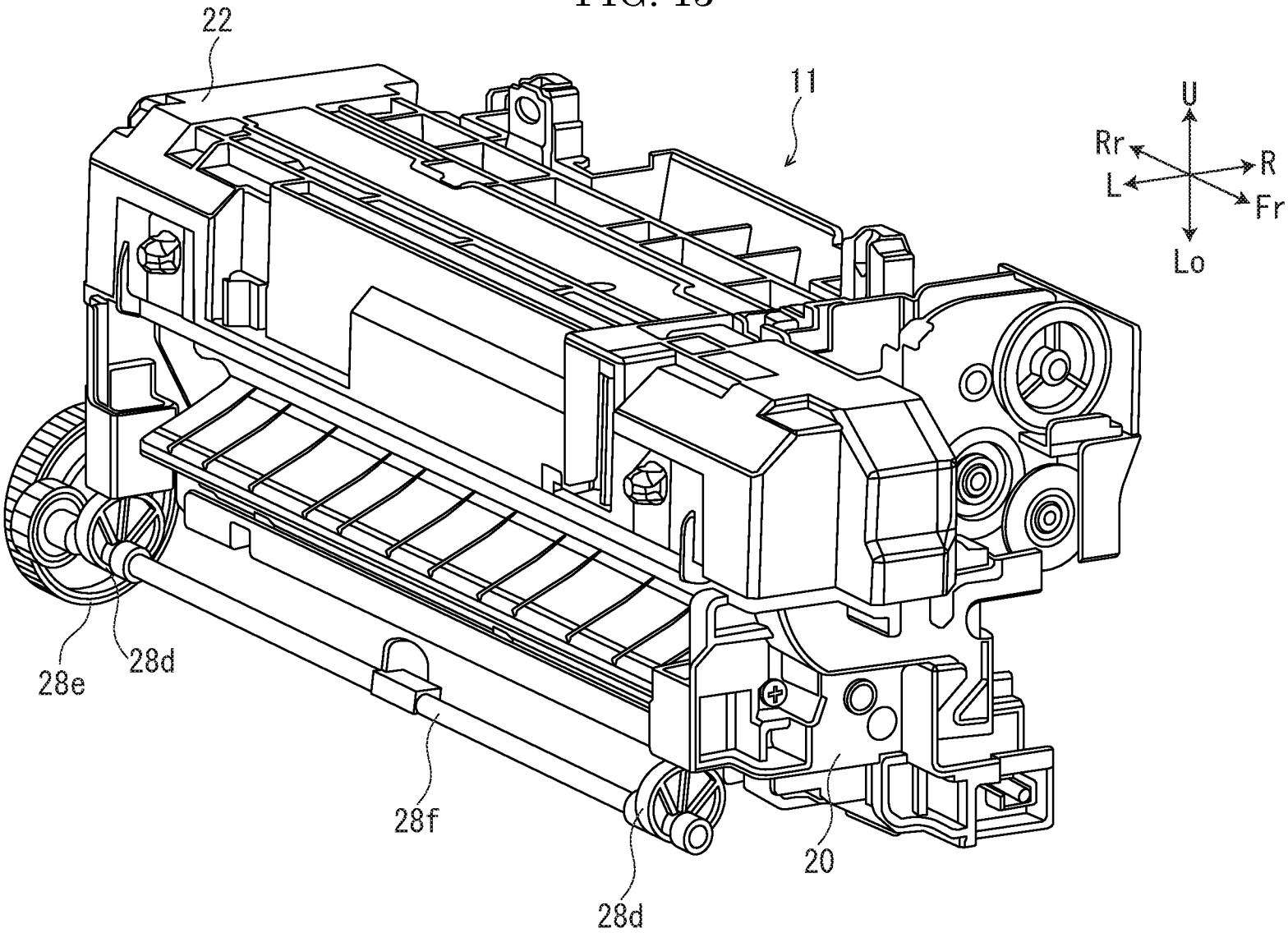
FIG. 13 is a perspective view showing the fixing device, as viewed from the upstream side, according to the modified example of the present disclosure.
Figure 14:
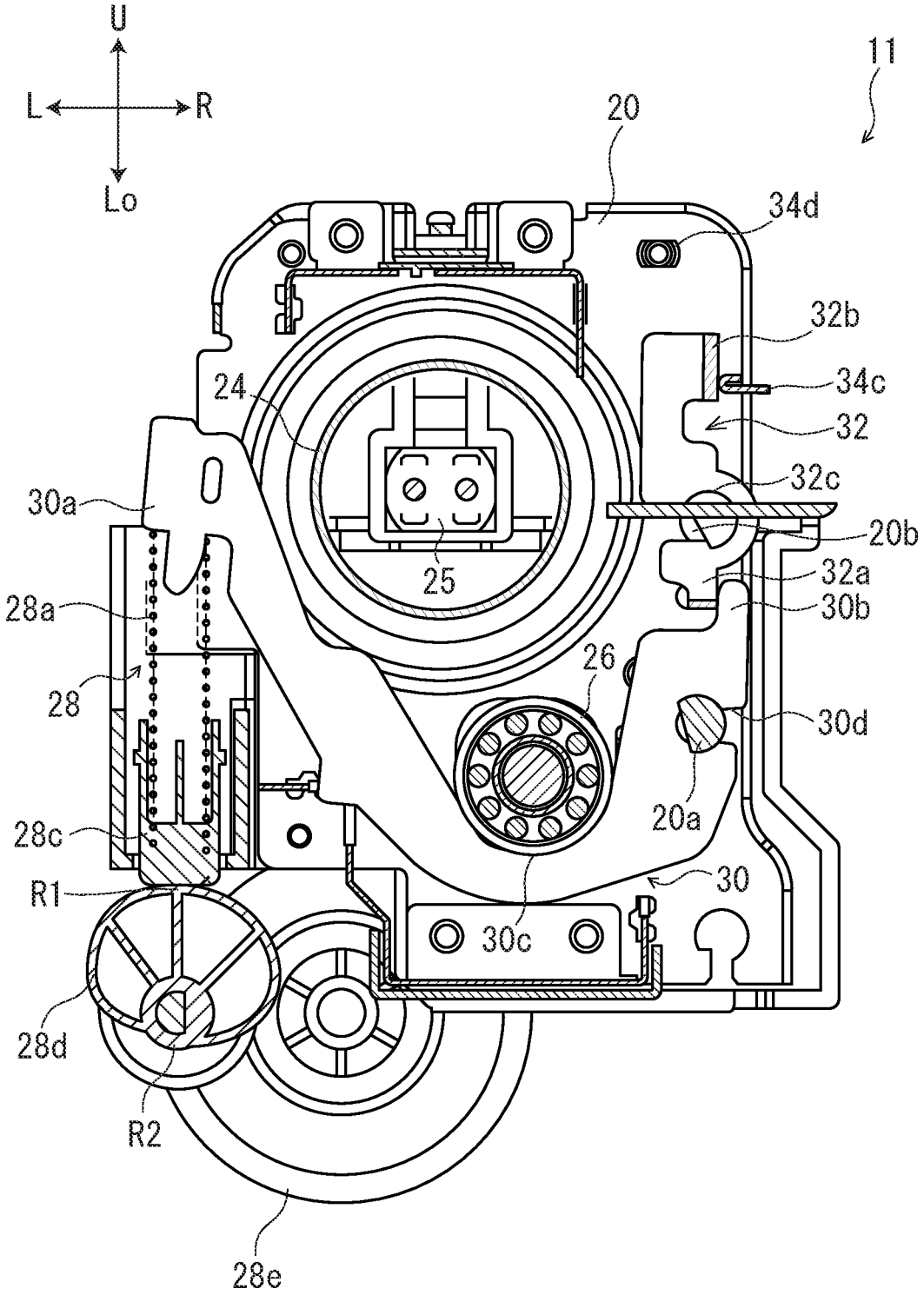
FIG. 14 is a sectional view showing the fixing device according to the modified example of the present disclosure.

FIGS. 11 and 12 are a perspective view and a sectional view showing a state that the release pressure (the second pressure) is applied to the fixing nip N by the eccentric cam 28*d*. Moreover, FIGS. 13 and 14 are a perspective view and a sectional view showing a state that the fixing pressure (the first pressure) is applied to the fixing nip N by the eccentric cam 28*d*.

A pair of eccentric cams 28*d* are rotatably supported by an eccentric shaft 28*f* extended in the forward and backward directions. The eccentric shaft 28*f* is connected to a not-shown cam motor via the drive gear train 28*e*. The eccentric cam 28*d* is a disk cam having various distances from its rotation center (the eccentric shaft 28*f*) to its outer circumferential face, and has a maximum radius portion R1, and a minimum radius portion R2 arranged away from the maximum radius portion R1, as examples. Under controlling of the controlling device 12, the eccentric cam 28*d* is rotated by the drive gear train 28*e*, and then, when the minimum radius portion R2 of the eccentric cam 28*d* faces to the biased part 28*c* (FIGS. 11 and 12), biasing of the compression spring 28*a* to the pressure applying member 30 is released and the release pressure is applied to the fixing nip N. In such a case, a gap is formed between the biased part 28*c* and the eccentric cam 28*d*, and the eccentric cam 28*d* does not press the compression spring 28*a*.

On the other hand, under controlling of the controlling device 12, the eccentric cam 28*d* is rotated by the drive gear train 28*e*, and then, when the maximum radius portion R1 of the eccentric cam 28*d* faces to the biased part 28*c* (FIGS. 13 and 14), the eccentric cam 28*d* together with the biased part 28*c* presses the compression spring 28*a* to an upper side, the compression spring 28*a* biases the pressure applying member 30 by spring pressure and the fixing pressure is applied to the fixing nip N.

According to the pressure adjusting mechanism 28 having the eccentric cam 28*d* as described above, interlocking operation of the separating member and the pressure applying member similar to the above-described embodiment can be actualized.

Figure 15:
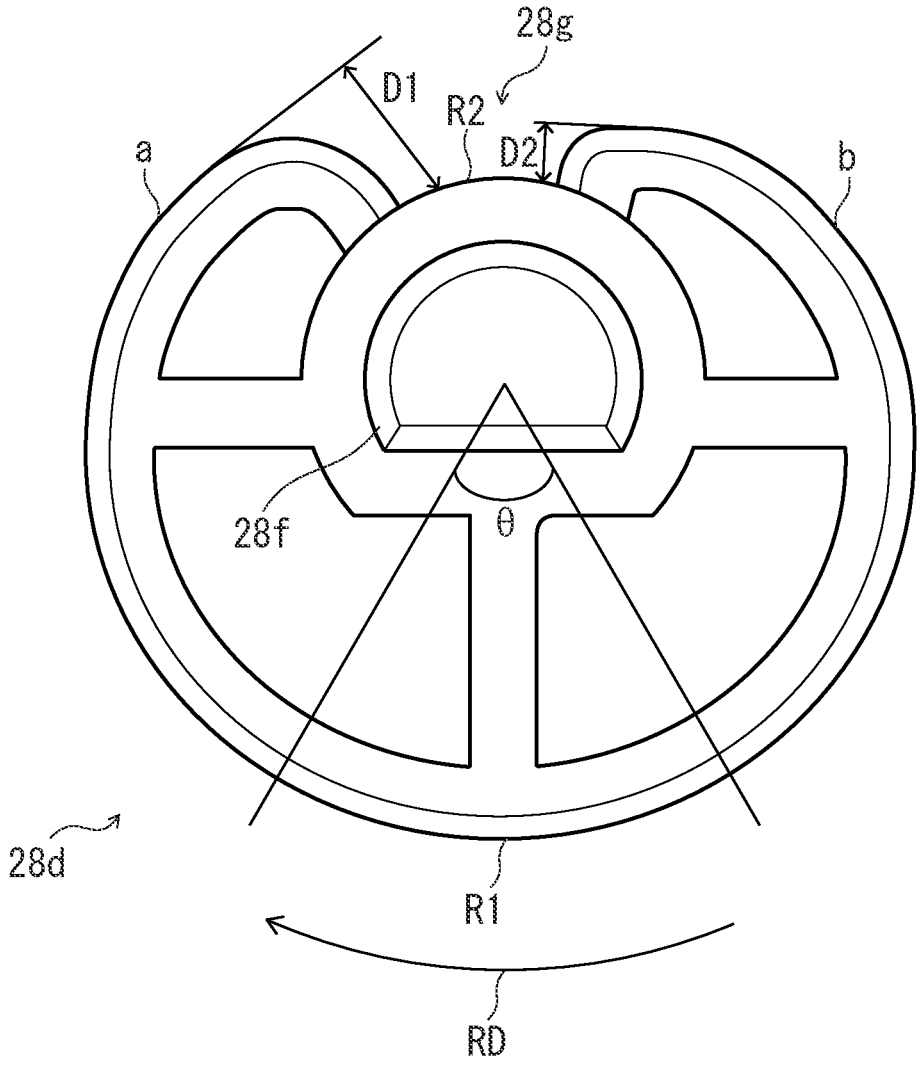
FIG. 15 is a front view showing an eccentric cam according to the modified example of the present disclosure.

With respect to the modified example of the present disclosure, the other example of the eccentric cam 28*d* of the pressure adjusting mechanism 28 will be described. As shown in FIG. 15, the eccentric cam 28*d* of this example has the maximum radius portion R1, and the minimum radius portion R2 arranged away from the maximum radius portion R1 and composed of a bottom face of a recessed portion 28*g* of the eccentric cam 28*d*. Other structures of the pressure adjusting mechanism 28 are similar to the above-described modified example with one example of the eccentric cam 28*d*.

The eccentric cam 28*d* as the other example has the maximum radius portion R1 far from the eccentric shaft 28*f*, and the minimum radius portion R2 arranged at a position separated from the maximum radius portion R1 by 180 degrees (an opposite position to the maximum radius portion R1 across the eccentric shaft 28*f*) close to the eccentric shaft 28*f*. The maximum radius portion R1 is formed by a width of a central angel θ of 60 degrees so that the biased part 28*c* is not protruded from the maximum radius portion R1, even if the biased part 28*c* is dispersedly positioned.

The minimum radius portion R2 of the eccentric cam 28*d* is composed of the bottom face of the recessed portion 28*g*, and when the biased part 28*c* faces to the minimum radius portion R2, a part of the biased part 28*c* is fitted into the recessed portion 28*g*. Thereby, when the eccentric cam 28*d* is switched from the maximum radius portion R1 to the minimum radius portion R2, spring pressure of the compression spring 28*a* is released, the biased part 28*c* is vigorously fitted into the recessed portion 28*g*, and repulsion power of the compression spring 28*a* affects jumping of the biased part 28*c* from the recessed portion 28*g*, but jumping out of the biased part 28*c* is restricted by a side wall of the recessed portion 28*g*.

Therefore, the biased part 28*c* does not pass the minimum radius portion R2 and stably stops at the minimum radius portion R2, and thereby, the eccentric cam 28*d* is prevented from going too far, the eccentric cam 28*d* is not rotated beyond rotation of the motor, and the eccentric cam 28*d* stops at a predetermined stop position, and accordingly, it is possible to stabilize the fixing pressure and to improve fixing performance of the fixing device 11.

The above-described recessed portion 28*g* has a depth D1 at an upstream side in a rotating direction RD of the eccentric cam 28*d* deeper than a depth D2 at a downstream side in the rotating direction RD. The eccentric cam 28*d* is formed to have an ascent inclined face a at a lower side of the recessed portion 28*g* (the upstream side in the rotating direction RD) and a descent inclined face b at an upper side of the recessed portion 28*g* (the downstream side in the rotating direction RD) in FIG. 15. Since the depth D1 of the ascent inclined face a of the recessed portion 28*g* is deeper than the depth D2 of the descent inclined face b of the recessed portion 28*g*, the eccentric cam 28*d* is formed in an asymmetric shape. Thereby, it is possible to smoothly face the biased part 28*c* to the recessed portion 28*g* of the eccentric cam 28*d* being rotated in a clockwise direction and to prevent the eccentric cam 28*d* from rotating too. Moreover, since the depth D2 of the descent inclined face b is shallower than the depth D1 of the ascent inclined face a, the descent inclined face b is gentle in comparison with the ascent inclined face a, and accordingly, it is possible to restrain force of going too far of the eccentric cam 28*d* to a minimum when the eccentric cam 28*d* is switched from the maximum radius portion R1 to the minimum radius portion R2.

In a state the biased part 28*c* faces to the minimum radius portion R2 of the eccentric cam 28*d*, a gap is formed between the biased part 28*c* and the bottom face (the minimum radius portion R2) of the recessed portion 28*g*. Thereby, it is possible to effectively release spring pressure of the compression spring 28*a* when the minimum radius portion R2 faces to the biased part 28*c*.

Although, in the above-described embodiment, the heating roller 24 is adopted as the heating member, the present disclosure may adopt the other optional heating member. For example, in another embodiment, a fixing film or a fixing belt may be adopted as the heating member.

Although, in the present embodiment, a case where the present disclosure is applied to the monochrome printer 1 has been described as one example, the disclosure is not restricted by this, but may be applied to a color printer, a copying machine, a facsimile, a multifunction peripheral or the like.

The above-description of the embodiments illustrates one aspect of the fixing device and the image forming apparatus including this according to the present disclosure, but the technical scope of the disclosure is not limited to the above-described embodiments.

The invention claimed is:

1. A fixing device comprising:

a heating member heating a toner on a recording medium;

a pressuring member coming into pressure contact with the heating member to form a pressuring area and pressurizing the recording medium passing through the pressuring area;

a pressure applying member pressing the pressuring member to generate predetermined fixing pressure in the pressuring area;

a pressure adjusting mechanism being capable of switching the fixing pressure applied by the pressure applying member between at least two steps of first pressure and second pressure lower than the first pressure;

a separating member coming into contact with the heating member to release the recording medium from the heating member; and an interlocking member positioned between the pressure applying member and the separating member, wherein the separating member comes into contact with the heating member by interlocking with the pressure applying member in a case where the pressure applying member applies the first pressure, and, on the other hand, the separating member is separated from the heating member by interlocking with the pressure applying member in a case where the pressure applying member applies the second pressure, wherein the pressure adjusting mechanism includes an elastic body being engaged with the pressure applying member; and a biasing part being capable of biasing the elastic body to the pressure applying member, wherein the pressure applying member includes an elastic body receiving part being arranged in one end of the pressure applying member to engage with the elastic body;

a first engaging part being arranged in the other end of the pressure applying member to engage with the interlocking member;

a holding part being arranged between the elastic body receiving part and the first engaging part to hold the pressuring member; and a first supporting part being arranged between the holding part and the first engaging part to support the pressure applying member turnably, wherein the interlocking member includes a second engaging part engaging with the first engaging part of the pressure applying member;

a third engaging part engaging with the separating member; and a second supporting part being arranged between the second engaging part and the third engaging part to support the interlocking member turnably, wherein the separating member includes a separating claw coming into contact with the heating member; and a holder part to which the separating claw is fixedly attached, wherein the holder part includes a fourth engaging part engaging with the third engaging part of the interlocking member; and a third supporting part supporting the separating member turnably and biasing the separating member in a direction making the separating claw come into contact with the heating member, wherein, when the biasing part of the pressure adjusting mechanism biases the elastic body, the pressure applying member is turned around the first supporting part in a first direction, the holding part presses the pressuring member to apply the first pressure to the pressuring area, and pressing of the first engaging part to the second engaging part is released, wherein the interlocking member is turned around the second supporting part in a second direction by releasing pressing to the second engaging part, and pressing of the third engaging part to the fourth engaging part is released, wherein the separating member is turned around the third supporting part in a third direction by releasing pressing to the fourth engaging part and biasing of the third supporting part, and the separating claw comes into contact with the heating member, wherein, when the biasing part of the pressure adjusting mechanism releases biasing to the elastic body, the pressure applying member is turned around the first supporting part in an opposite direction to the first direction, pressing of the holding part to the pressuring member is released to apply second pressure to the pressuring area, and the first engaging part presses the second engaging part, wherein the interlocking member is turned around the second supporting part in an opposite direction to the second direction by pressing to the second engaging part, and the third engaging part presses the fourth engaging part, and wherein the separating member is turned around the third supporting part in an opposite direction to the third direction by pressing to the fourth engaging part, and the separating claw is separated from the heating member.

2. The fixing device according to claim 1, wherein the pressure adjusting mechanism adjusts the pressure applying member so as to release the first pressure and to apply the second pressure to the pressuring area in a case where a high basis weight paper as the recording medium is passed through the pressuring area.

3. An image forming apparatus comprising:

the fixing device according to claim 2.

4. The fixing device according to claim 1, wherein the pressure adjusting mechanism includes a compression spring as the elastic body;

an eccentric cam as the biasing part;

a biased part put between the compression spring and the eccentric cam; and a drive gear train transmitting drive force to the eccentric cam to rotate the eccentric cam, wherein the eccentric cam has a maximum radius portion and a minimum radius portion arranged away from the maximum radius portion, and has a recessed portion, wherein the maximum radius portion is composed of a bottom face of the recessed portion, and wherein, when the maximum radius portion faces to the biased part, the eccentric cam together with the biased part presses the compression spring, the compression spring biases the pressure applying member by spring pressure, and the first pressure is applied to the pressuring area, and, on the other hand, when the minimum radius portion faces to the biased part, biasing of the compression spring to the pressure applying member is released, and the second pressure is applied to the pressuring area.

5. The fixing device according to claim 4, wherein the recessed portion is formed so that a depth at an upstream side in a rotating direction of the eccentric cam is deeper than a depth at a downstream side in the rotating direction.

6. An image forming apparatus comprising:

the fixing device according to claim 5.

7. The fixing device according to claim 4, wherein in a state the biased part faces to the minimum radius portion of the eccentric cam, a gap is formed between the biased part and the bottom face of the recessed portion.

8. An image forming apparatus comprising:

the fixing device according to claim 7.

9. The fixing device according to claim 4, wherein the maximum radius portion is arranged separate from an eccentric shaft supporting the eccentric cam rotatably by a predetermined maximum radius, and the minimum radius portion is arranged separate from the eccentric shaft by a predetermined minimum radius.

10. An image forming apparatus comprising:

the fixing device according to claim 9.

11. The fixing device according to claim 4, wherein the eccentric cam has an ascent inclined face at an upstream side from the recessed portion in a rotating direction of the recessed portion eccentric cam and a descent inclined face at a downstream side from the recessed portion in the rotating direction, and the descent inclined face is gentle in comparison with the ascent inclined face.

12. An image forming apparatus comprising:

the fixing device according to claim 11.

13. An image forming apparatus comprising:

the fixing device according to claim 4.

14. An image forming apparatus comprising:

the fixing device according to claim 1.

* * * * *